US006570309B2

(12) United States Patent
Omori et al.

(10) Patent No.: US 6,570,309 B2
(45) Date of Patent: May 27, 2003

(54) CATHODE RAY TUBE

(75) Inventors: Masayuki Omori, Osaka (JP); Tadayuki Sato, Hyogo (JP); Yoshikazu Demi, Shiga (JP); Ayumu Takakuwa, Hyogo (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 21 days.

(21) Appl. No.: 10/004,705

(22) Filed: Dec. 4, 2001

(65) Prior Publication Data

US 2002/0070654 A1 Jun. 13, 2002

(30) Foreign Application Priority Data

Dec. 13, 2000 (JP) ..... 2000-379294

(51) Int. Cl.[7] ..... H01J 29/80
(52) U.S. Cl. ..... 313/402; 313/403; 313/407
(58) Field of Search ..... 313/402, 403, 313/407

(56) References Cited

U.S. PATENT DOCUMENTS 4,942,332 A 7/1990 Adler et al.
4,942,333 A 7/1990 Knox
5,990,607 A 11/1999 Tseng et al.

*Primary Examiner*—Vip Patel
(74) *Attorney, Agent, or Firm*—Merchant & Gould, P.C.

(57) ABSTRACT

A cathode ray tube including a pair of supports arranged in parallel facing each other and a shadow mask acting as a color selection electrode including a large number of apertures. The shadow mask is stretched and held by the supports in a state in which tension is applied by the supports. In the shadow mask before being stretched onto the supports, the shapes of the apertures are varied so that the width of the apertures in the middle portion in the direction in which tension is to be applied narrows gradually from the central portion towards the both end portions in the direction parallel to the longitudinal direction of the support. Thereby, the shapes of the apertures can be made to be uniform over the entire surface in a state in which the shadow mask is stretched. As a result, a cathode ray tube with less color unevenness can be provided.

4 Claims, 11 Drawing Sheets

CATHODE RAY TUBE

BACKGROUND OF THE INVENTION

1. Field of the Invention

The present invention relates to a cathode ray tube. More specifically, it relates to a cathode ray tube having a shadow mask stretched with the application of tension in one direction.

2. Description of the Prior Art

In a color cathode ray tube, a phosphor screen formed on an inner surface of a face panel is irradiated with electron beams emitted from an electron gun, and a desired image is displayed. At the side of the electron gun of the phosphor screen, a shadow mask acting as a color selection electrode is provided at a predetermined space from the phosphor screen. The shadow mask has a large number of substantially rectangular-shaped apertures (electron beam through holes) arranged so that the electron beams can strike the phosphors in predetermined positions.

When the electron beams impinge on the shadow mask, the shadow mask is thermally expanded. Thereby, the positions of the apertures are displaced and the electron beams passing through the apertures do not strike the phosphors in predetermined positions correctly, which can lead to color unevenness. Such a phenomenon is referred to as "doming." In order to prevent this, the shadow mask is stretched and held by a mask frame in a state in which tension is applied to the shadow mask in advance so as to absorb the thermal expansion due to the temperature increase. Thus, even if the temperature of the shadow mask is increased, it is possible to reduce the amount of relative displacement between the apertures of the shadow mask and the phosphor stripes formed on the phosphor screen.

The phosphor screen can be obtained by forming and arranging black stripes having a substantially rectangular grid shape whose longitudinal direction is the vertical direction; and then sequentially forming phosphors corresponding to each color of red, green and blue in the apertures of the black stripes. The black stripes are formed through exposing to light via the shadow mask, which has been stretched as mentioned above and installed to the face panel.

Recently, with development of computer technology, etc., an image with high definition has been demanded and the pitch of display pixels is becoming finer. Namely, the width of the aperture of the shadow mask and the arrangement pitch of black stripes are becoming finer. Accordingly, there arises a problem in that color unevenness in a display image occurs over the entire screen.

The present inventors have investigated the cause of the color unevenness and found that it is because the apertures of black stripes are formed nonuniformly over the entire screen.

FIGS. 10A and 10B are partially enlarged views schematically showing black stripes formed on the inner surface of the face panel. The vertical direction on both drawings corresponds to the vertical direction of the screen of the cathode ray tube. FIG. 10A shows an ideal pattern of the black stripes. When the black stripes are formed in a line pattern including a large number of uniform parallel lines as shown in FIG. 10A, color unevenness does not occur. However, in the cathode ray tube in which color unevenness occurs as mentioned above, as shown in FIG. 10B, lightness and darkness periodically appear in lines, and thus the black stripes are formed in a checked pattern.

As a result of further investigation, the reason why the black stripes are formed in the checked pattern as mentioned above is because the shapes of the apertures of the shadow mask used at the time of formation of the black stripes are deformed into a shape different from the designed shape.

FIGS. 11A and 11B are partially enlarged views showing apertures of a shadow mask stretched and held by a mask frame. In FIGS. 11A and 11B, the arrow T illustrates tension applied to the shadow mask.

As shown in the drawings, in the conventional shadow mask, the apertures, which are formed in a substantially rectangular shape before the shadow mask is stretched onto the mask frame, are deformed when the shadow mask is stretched and held by the mask frame with the application of tension T. The aperture is deformed into, for example, a "bobbin shape" in which the width (width of the aperture in the direction perpendicular to the direction in which tension T is applied) of the aperture of the substantially middle portion in the direction in which tension T is applied becomes narrow (see FIG. 11A); or on the contrary, a "barrel shape" in which the width of the aperture of the substantially middle portion in the direction in which tension T is applied becomes large (see FIG. 11B). The deformation of the apertures into the bobbin shape or barrel shape may lead to formation of the black stripes having the checked pattern as shown in FIG. 10B.

Furthermore, whether the aperture of the shadow mask is deformed into the bobbin shape or the barrel shape depends on the size of the cathode ray tube (i.e., the size of the shadow mask), the magnitude of tension applied, and the like. Furthermore, even on one shadow mask, the apertures may be deformed in a different way depending on the positions on the screen (i.e. a central portion versus a peripheral portion on the screen).

The shapes of the apertures of the shadow mask, which should be of a uniform rectangular shape over the entire screen, are varied into various shapes as mentioned above, by stretching the shadow mask onto the mask frame. When the shapes of the apertures of the shadow mask are different in accordance with the positions on the screen, black stripes also are formed in different patterns in accordance with the positions on the screen, that is, in the line pattern as shown in FIG. 10A in one part and in the checked pattern as shown in FIG. 10B in another part. Therefore, shapes of the phosphors of red, green and blue formed in the apertures of the black stripes become different in one screen, which may lead to a problem, for example, an occurrence of color unevenness between the central portion and the peripheral portion on the screen.

SUMMARY OF THE INVENTION

With the foregoing in mind, it is an object of the present invention to provide a cathode ray tube having less color unevenness by forming all the apertures on the entire screen to have substantially uniform shapes as desired in a state in which the shadow mask is stretched.

In order to achieve the above-mentioned object, the present invention has the below-mentioned configurations.

According to the present invention, a cathode ray tube includes a pair of supports arranged in parallel facing each other, and a shadow mask acting as a color selection electrode including a large number of apertures. The shadow mask is stretched and held by the supports in a state in which tension is applied by the supports. In the cathode ray tube, in the shadow mask before being stretched onto the supports, the shapes of the aperture are varied so that the width of the aperture in the middle portion in the direction in which tension is to be applied gradually narrows from a central portion towards both end portions in the direction parallel to the longitudinal direction of the support.

With such a configuration, by using the shadow mask that has apertures whose shapes are varied in the direction perpendicular to the direction in which tension is to be applied before the shadow mask is stretched, it is possible to obtain the apertures having uniform shapes over the entire surface in a state in which the shadow mask is stretched. As a result, a cathode ray tube with less color unevenness can be provided.

It is preferable that in the shadow mask before being stretched onto the supports, the width of the shadow mask in the direction parallel to the longitudinal direction of the support is wide in the both end portions and narrow in the middle portion in the direction in which tension is to be applied. Furthermore, it is preferable that tension applied to the shadow mask in the central portion is larger than tension applied to the shadow mask in the both end portions in the direction parallel to the longitudinal direction of the support.

As examples of the shapes of the apertures, for example, in the shadow mask before being stretched onto the supports, the apertures formed in the central portion in the direction parallel to the longitudinal direction of the support have a barrel shape having a large width in the middle portion in the direction in which tension is to be applied, and the apertures formed in the both end portions in the direction parallel to the longitudinal direction of the support have a bobbin shape having a narrow width in the middle portion in the direction in which tension is to be applied.

BRIEF DESCRIPTION OF THE DRAWINGS

FIG. 11A shows an aperture deformed into a bobbin shape; and FIG. 11B shows an aperture deformed into a barrel shape.

DESCRIPTION OF THE PREFERRED EMBODIMENTS

Figure 1:
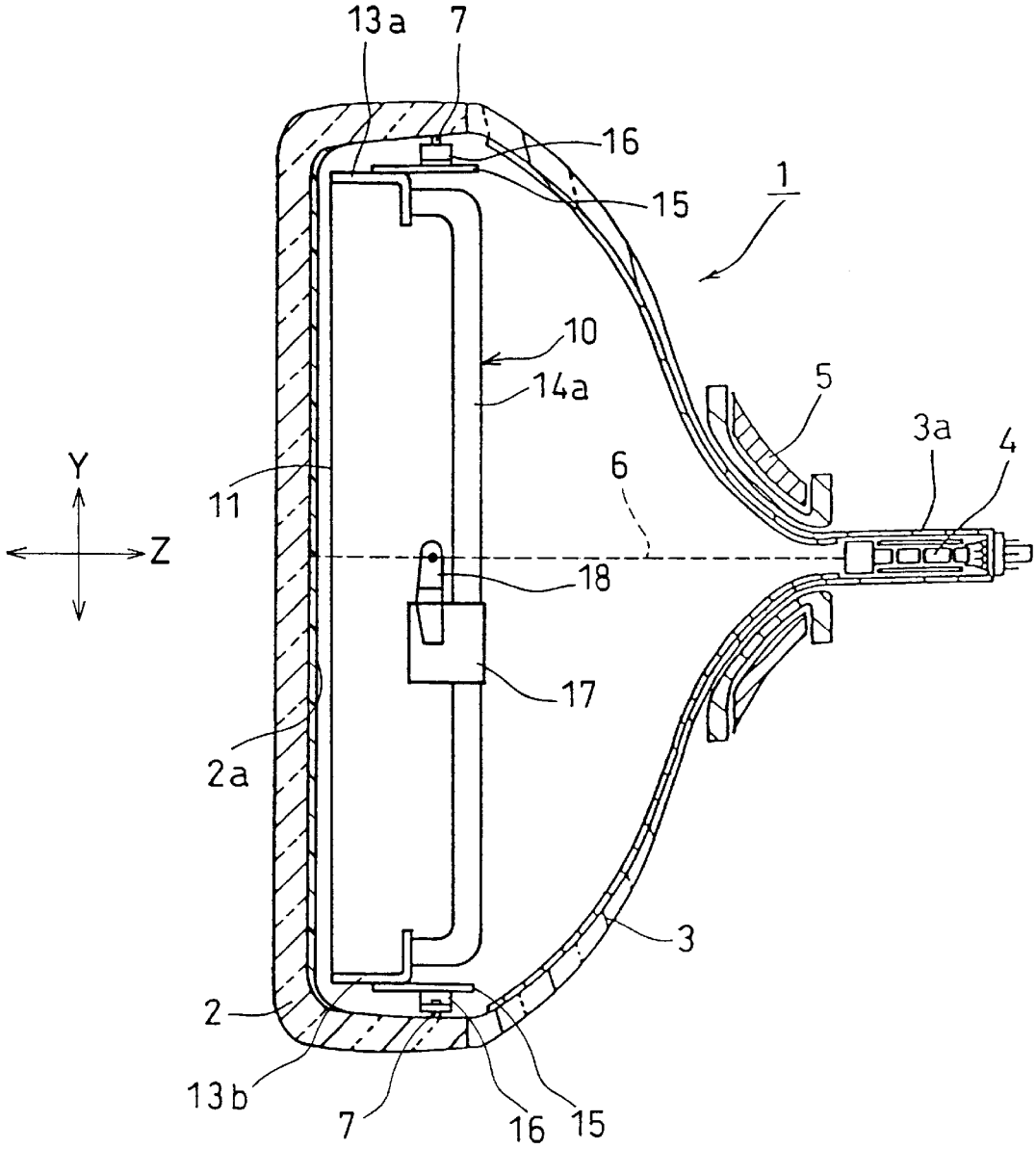
FIG. 1 is a sectional view showing a color cathode ray tube along the tube axis according to the present invention.

FIG. 1 is a sectional view showing a color cathode ray tube of the present invention. The color cathode ray tube 1 shown in FIG. 1 includes a face panel 2 having a rectangular-shaped phosphorous screen 2*a* on an inner surface thereof; a funnel 3 connected to the rear side of the face panel 2; an electron gun 4 incorporated in a neck portion 3*a* of the funnel 3 and a shadow mask 11 disposed facing the phosphorous screen 2*a* inside the face panel 2. Furthermore, a deflection yoke 5 is provided on a peripheral surface of the funnel 3 in order to deflect and scan the electron beams 6 emitted from the electron gun 4 on the phosphorous screen 2*a*.

The shadow mask 11 provides color selection with respect to three electron beams 6 emitted from the electron gun 4. The shadow mask 11 is made of a metal plate on which a large number of substantially slot-shaped apertures (electron beam through holes) are formed by etching.

Hereinafter, for convenience in explanation, an XYZ-three dimensional rectangular coordinate system is taken. In the coordinate system, an X-axis is a horizontal axis passing through the tube axis and being perpendicular to the tube axis, a Y-axis is a vertical axis passing through the tube axis and being perpendicular to the tube axis, and Z-axis is the tube axis.

Figure 2:
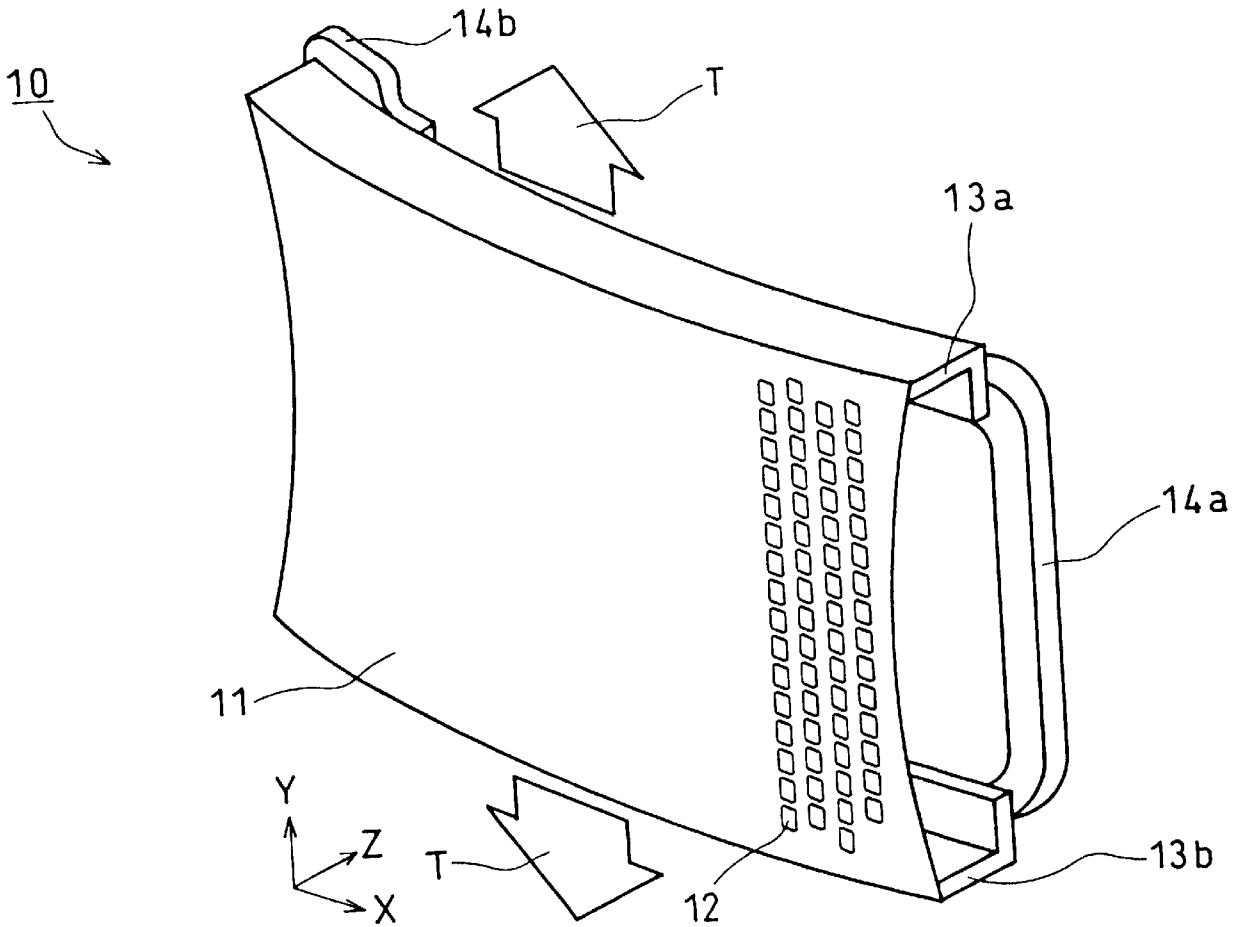
FIG. 2 is a schematic perspective view showing a mask structure installed in the color cathode ray tube of FIG. 1.

FIG. 2 is a schematic perspective view showing a mask structure 10, which is installed in the color cathode ray tube 1 of FIG. 1, including the shadow mask 11 and a mask frame holding the shadow mask 11 in a stretched condition.

The mask structure 10 includes a pair of supports 13*a* and 13*b* having a substantially L-shaped cross section; a pair of holding members 14*a* and 14*b* having a hollow quadrangular prism shape; and the shadow mask 11 stretched onto the pair of supports 13*a* and 13*b* in which tension T is applied in the Y-axis direction. The pair of supports 13*a* and 13*b* disposed at a predetermined space from each other in parallel in the X-axis direction, and the pair of holding members 14*a* and 14*b* deformed into an angular U-shape are assembled into a substantially rectangular-shaped frame and welded at the connecting portions. Thereby, the mask frame is formed.

The shadow mask 11 has a substantially rectangular shape. The end portions of the longer side of the shadow mask 11 are welded to the end portions at the free end sides of the supports 13*a* and 13*b*. At this time, the shadow mask is welded and fixed to the pair of supports 13*a* and 13*b* while external forces are applied to the end portions at the free end sides of the pair of supports 13*a* and 13*b* in the direction in which the end portions at the free end sides are approaching to each other and while tension in the Y-axis direction is applied to the shadow mask 11 by grasping the end portions in the Y-axis direction of the shadow mask 11. Thereby, the shadow mask 11 is stretched in a state in which tension T is applied in the Y-axis direction parallel to the shorter side thereof as shown in FIG. 2. A large number of the apertures 12 (electron beams through holes) are formed on the shadow mask 11 by etching (in FIG. 2, only some of the apertures 12 are shown schematically).

As shown in FIG. 1, a plate-shaped member 15 for mounting a spring is adhered to the peripheral surface of the pair of supports 13*a* and 13*b* respectively, and a plate-shaped spring 16 is fixed to the plate-shaped member 15. Similarly, a plate-shaped member 17 for mounting a spring is adhered to the pair of holding members 14*a* and 14*b* respectively, and a plate-shaped spring 18 is fixed to the plate-shaped member 17.

On four inner wall faces of the face panel 2, fixing pins 7 are embedded. By inserting these four fixing pins 7 into holes formed on the spring members 16 and 18, the mask structure 10 is installed on the face panel 2.

The apertures 12 formed on the shadow mask 11 of the present invention are formed in the predetermined shapes before the shadow mask is stretched so that the apertures have desired uniform rectangular shapes in a state in which the shadow mask is stretched and held by the mask structure 10 with the application of tension T.

Hereinafter, the present invention will be explained more specifically.

First Embodiment

Figure 3:
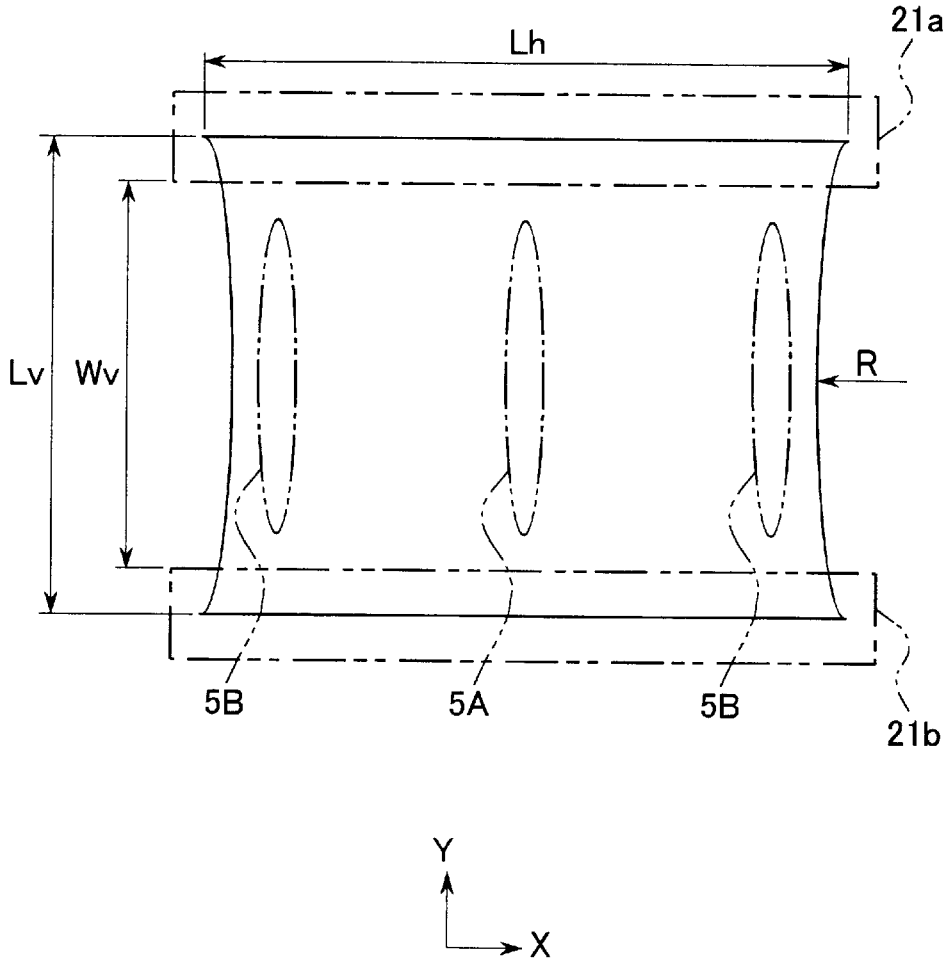
FIG. 3 is a front view showing a shadow mask used for a 29-inch diagonal cathode ray tube before the shadow mask is stretched in a first embodiment according to the present invention.

FIG. 3 is a front view showing a shadow mask used for a 29-inch diagonal cathode ray tube before being stretched in a first embodiment according to the present invention. The shadow mask of this embodiment has a so-called bobbin shape in which both end portions of the shadow mask in the X-axis direction are recessed in an arc shape (that is, the width of the shadow mask in the X-axis direction is wide in the both end portions and narrow in the central portion in the Y-axis direction). Portions surrounded by double-dashed lines 21*a* and 21*b* show grasping portions of a stretcher for applying a predetermined tension to the shadow mask when stretching the shadow mask onto the mask frame. The portions in the grasping portions 21*a* and 21*b* are cut off after the shadow mask is stretched onto the mask frame. In FIG. 3, the length of the shadow mask along the X-axis direction at the end portions in the Y-axis direction is Lh=541 mm; the space between the pair of supports (supports 13*a* and 13*b* in FIG. 2) of the mask frame onto which the shadow mask is stretched is Wv=410 mm; the length of the shadow mask along the Y-axis is Lv=550 mm; and the radius of curvature of the arc in the both end portions in the X-axis direction is R=5000 mm. The center of the arc is provided on the X-axis.

Figure 4:
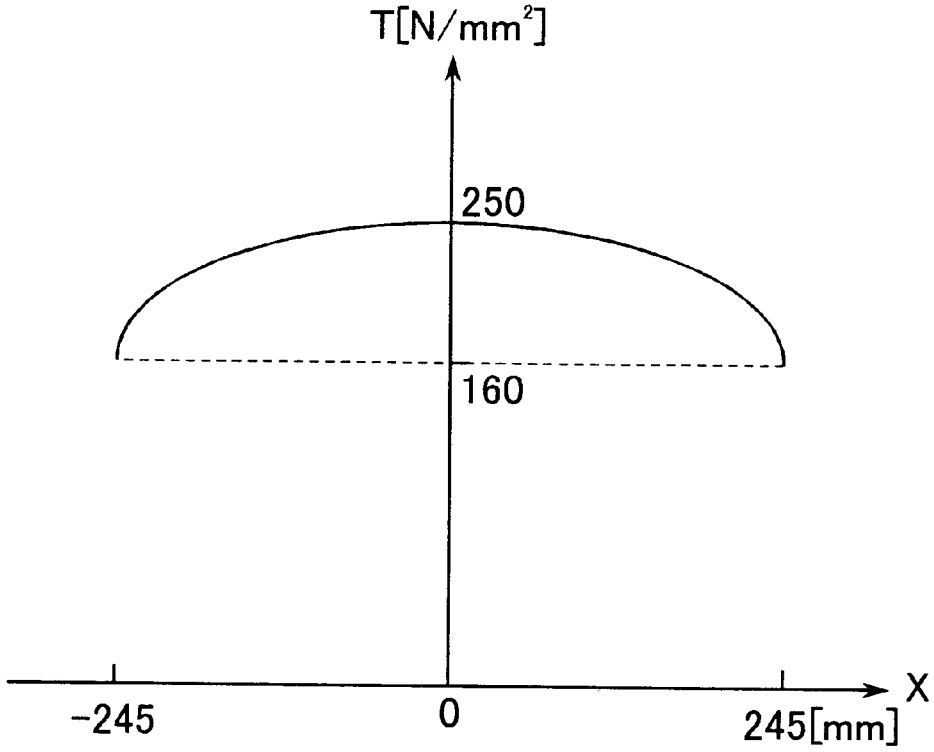
FIG. 4 is a graph showing the distribution in the X-axis direction of tension applied to a shadow mask in a first embodiment of the present invention.

FIG. 4 is a graph schematically showing the distribution in the X-axis direction of tension applied to the shadow mask when the shadow mask shown in FIG. 3 is stretched onto the mask frame as shown in FIG. 2. In FIG. 4, an axis of the abscissa shows a position on the X-axis direction, the center of the screen (an intersectional point between the X-axis and the tube axis) is a point of X=0 (mm), and the right side of the screen is a direction of a plus region in the X-axis. Furthermore, an axis of the ordinate shows the tension of each position on the X-axis. As shown in the drawing, tension applied to the shadow mask is not uniform in the X-axis direction, and is larger in the central portion of the screen than in the both end portions thereof.

In the shadow mask of this embodiment of the present invention, the shapes of the apertures before the shadow mask is stretched are varied as follows by corresponding to the distribution of tension in the X-axis direction.

Figure 5A:
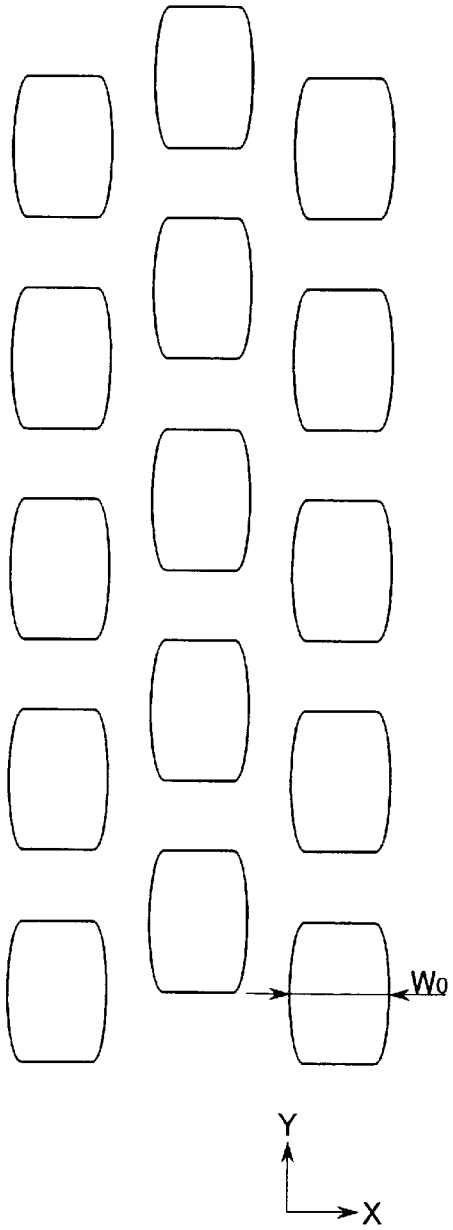
FIGS. 5A and 5B are enlarged views showing the shape of the apertures in the central portion and the end portions in the X-axis direction before the shadow mask is stretched in a first embodiment of the present invention.
Figure 5B:
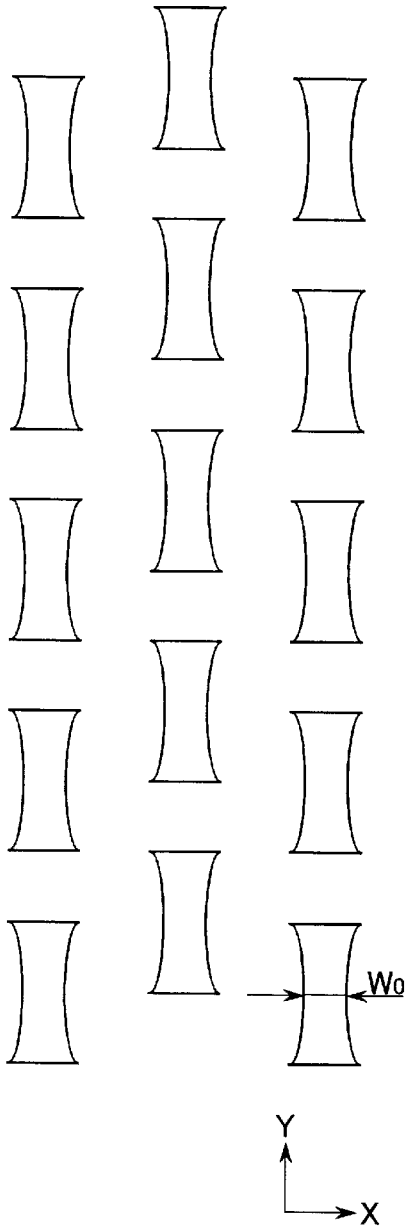

The shapes of the apertures in the central portion 5A and the end portions 5B in the X-axis direction in FIG. 3 are shown in detail in FIGS. 5A and 5B, respectively. As shown in the drawings, in this embodiment, the apertures of the region 5A in the central portion in the X-axis direction are formed in a barrel shape in which the width (width of the apertures in the X-axis direction) is made to be large in the central portion in the Y-axis direction; the apertures of the region 5B in the both end portions in the X-axis direction are formed in a bobbin shape in which the width (width of the aperture in the X-axis direction) is made to be narrow in the central portion in the Y-axis direction; and the shapes of the apertures from the central portion 5A to the end portion 5B are varied gradually from the barrel shape to the bobbin shape.

The specific sizes of the aperture are shown below.

Figure 6:
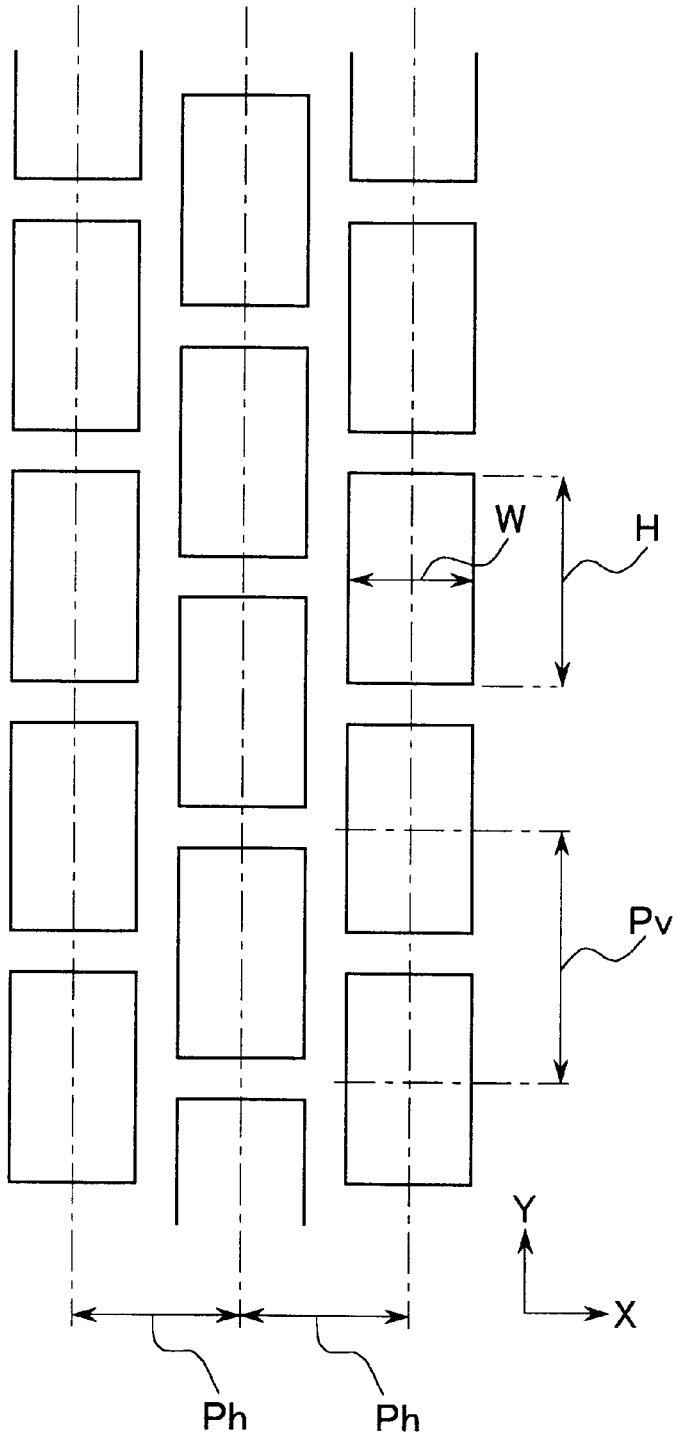
FIG. 6 is an enlarged front view showing an intended form of the apertures in a state in which the shadow mask is stretched.

FIG. 6 is an enlarged front view showing an intended form of the apertures in a state in which the shadow mask is stretched. In the shadow mask used for the 29-inch diagonal cathode ray tube of this embodiment, the apertures have substantially exact rectangular shapes; the width of the aperture in the X-axis direction is W=0.2 mm; the width of the aperture in the Y-axis direction is H=10 mm; the arrangement pitch of the apertures in the X-axis direction is Ph=0.8 mm; and the arrangement pitch of the apertures in the Y-axis direction is Pv=11 mm.

In the shadow mask before being stretched, when both of the maximum width of the barrel-shaped aperture shown in FIG. 5A in the X-axis direction and the minimum width of the bobbin-shaped aperture shown in FIG. 5B in the X-axis direction are W0, the correction rate C (%) of the width of the aperture in the X-axis direction is represented by the following equation:

$$C=(\mathrm{W0}-W)/W\times 100.$$

At this time, the correction rates C of the barrel-shaped aperture shown in FIG. 5A (central portion 5A in FIG. 3) and the bobbin-shaped aperture shown in FIG. 5B (end portions 5B in FIG. 3) are +3% and −5%, respectively. The correction rates of the apertures positioned from the central portion 5A to the end portions 5B are varied gradually from +3% to −5%. The widths of the apertures in the end portion in the Y-axis direction are substantially constant (the width of the end portions 5B is narrower than that of the central portion 5A by 1%).

The shadow mask including the above-mentioned apertures was stretched while applying tension shown in FIG. 4, thereby forming the mask structure 10 shown in FIG. 2. Consequently, it was confirmed that the apertures had rectangular shapes as designed over the entire surface. Furthermore, when the cathode ray tube 1 shown in FIG. 1 incorporating this mask structure 10 was produced, color unevenness was hardly found over the entire screen.

Second Embodiment

Figure 7:
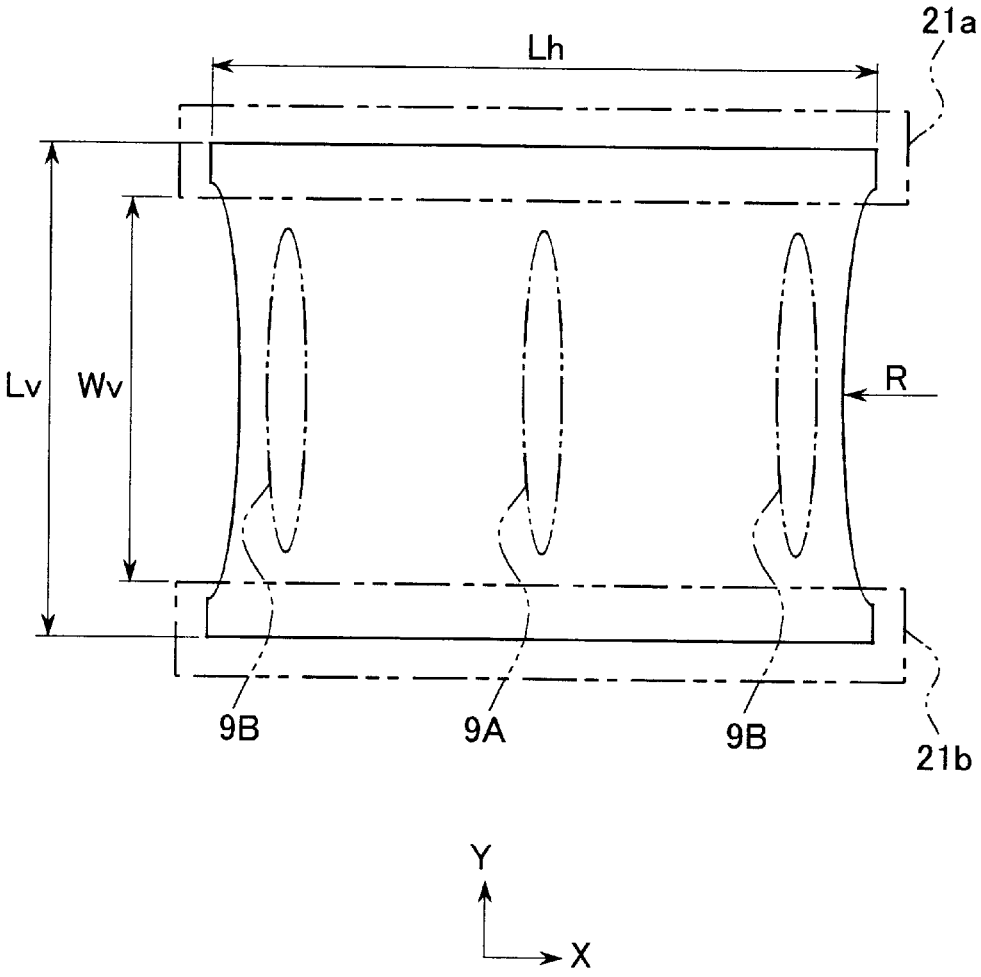
FIG. 7 is a front view showing a shadow mask used for a 25-inch diagonal cathode ray tube before the shadow mask is stretched in a second embodiment according to the present invention.

FIG. 7 is a front view showing a shadow mask used for a 25-inch diagonal cathode ray tube before being stretched in a second embodiment according to the present invention. The shadow mask of this embodiment has a so-called bobbin shape in which both end portions of the shadow mask in the X-axis direction are recessed in an arc shape (that is, the width of the X-axis direction of the shadow mask is wide in the both end portions and narrow in the central portion in the Y-axis direction). Portions surrounded by double-dashed lines 21*a* and 21*b* show grasping portions of a stretcher for applying a predetermined tension to the shadow mask when stretching the shadow mask onto the mask frame. The portions in the grasping portions 21*a* and 21*b* are cut off after the shadow mask is stretched onto the mask frame. In FIG. 7, the length of the shadow mask along the X-axis at the end portions in the Y-axis direction is Lh=487 mm; the space between the pair of supports (supports 13*a* and 13*b* in FIG. 2) of the mask frame onto which the shadow mask is stretched is Wv=360 mm; the length of the shadow mask along the Y-axis is Lv=550 mm; and the radius of curvature of the arc in the both end portions in the X-axis direction is R=2500 mm. The center of the arc is provided on the X-axis.

Figure 8:
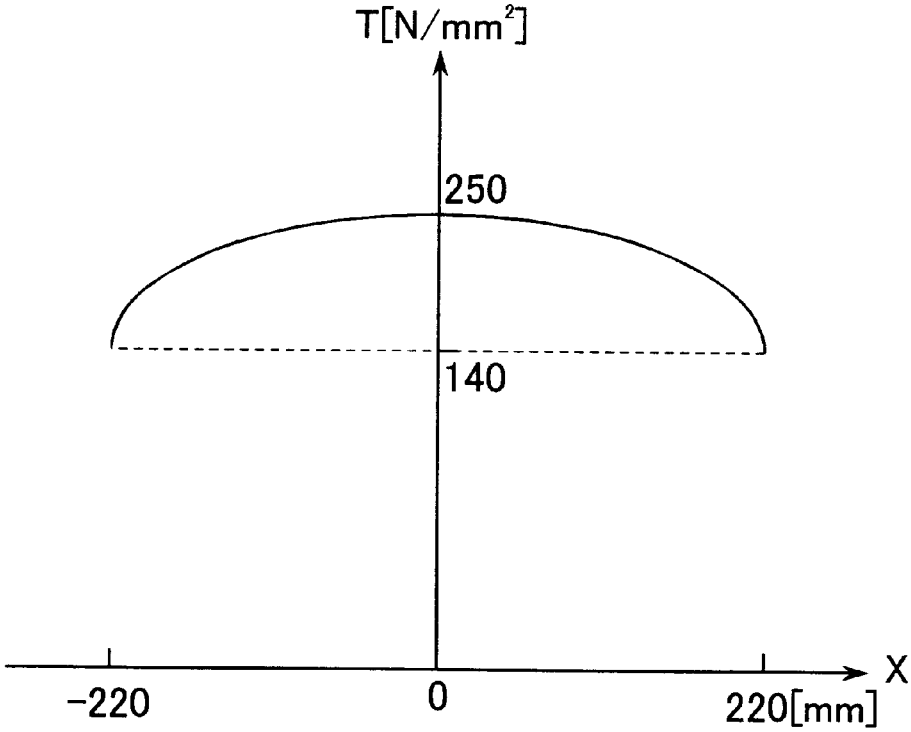
FIG. 8 is a graph showing the distribution in the X-axis direction of tension applied to a shadow mask in a second embodiment of the present invention.

FIG. 8 is a graph schematically showing the distribution in the X-axis direction of tension applied to the shadow mask when the shadow mask shown in FIG. 7 is stretched onto the mask frame as shown in FIG. 2. FIG. 8 is shown in the same way as in FIG. 4. As shown in FIG. 8, tension applied to the shadow mask is not uniform in the X-axis direction and is larger in the central portion of the screen than in the portion on the both end portions thereof.

In the shadow mask of this embodiment of the present invention, the shapes of the apertures before the shadow mask is stretched are varied as follows by corresponding to the distribution of tension in the X-axis direction.

Figure 9A:
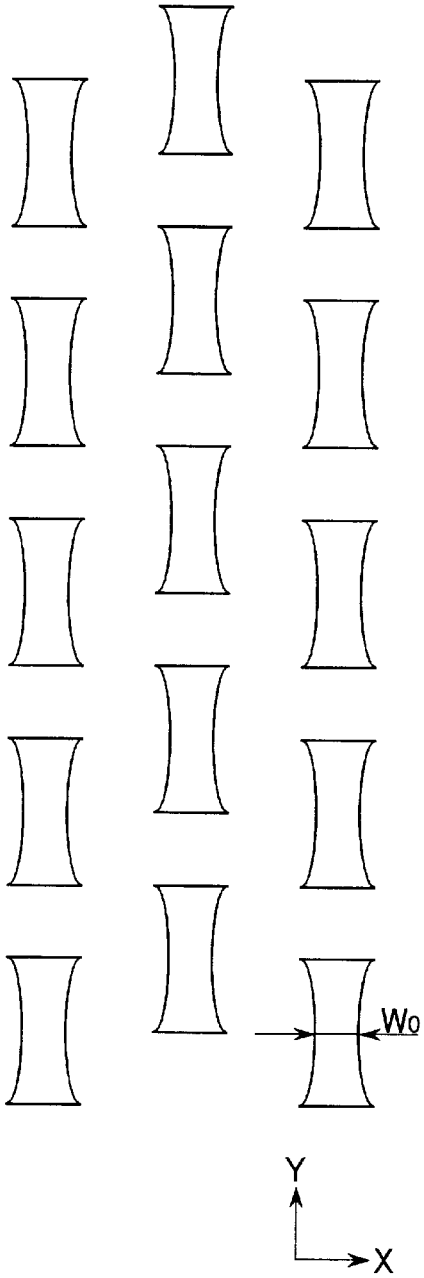
FIGS. 9A and 9B are enlarged views showing the shape of the apertures in the central portion and the end portions in the X-axis direction in a state before a shadow mask is stretched in a second embodiment of the present invention.
Figure 9B:
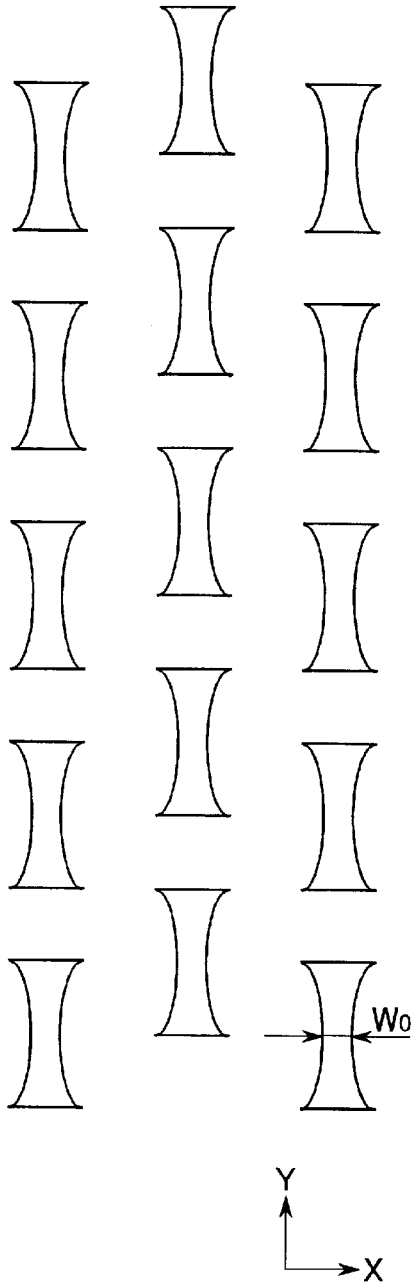
Figure 10A:
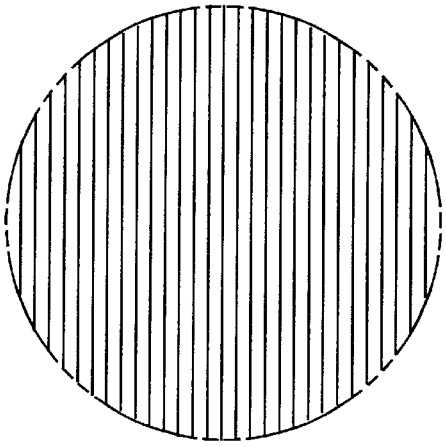
FIG. 10A is an enlarged view showing black stripes having an ideal line pattern.
Figure 10B:
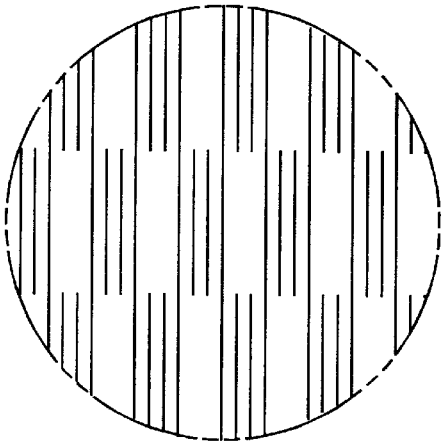
FIG. 10B is an enlarged view showing black stripes having a checked pattern.
Figure 11A:
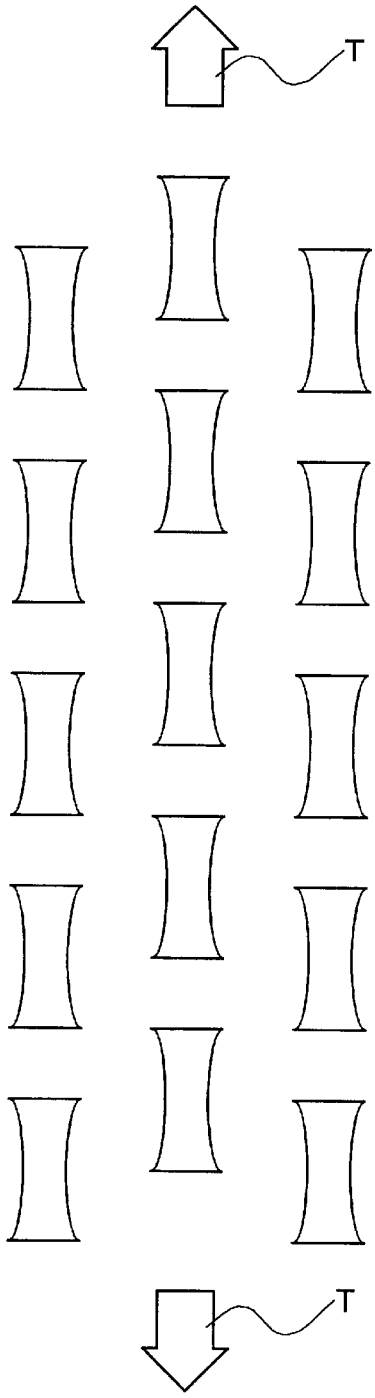
FIG. 11A (PRIOR ART)
FIGS. 11A and 11B are enlarged front views showing a state in which apertures of a shadow mask are deformed in a conventional cathode ray tube.
Figure 11B:
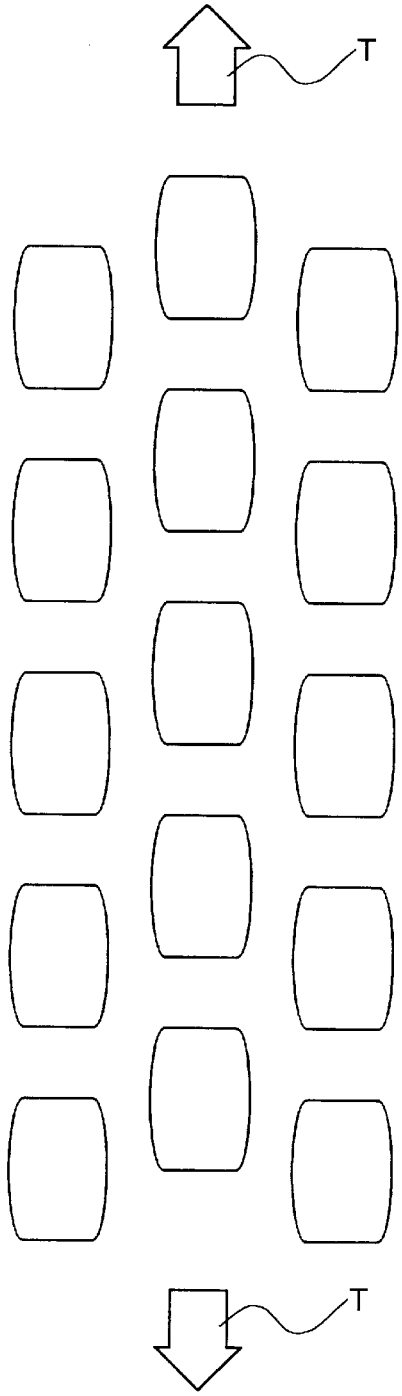
FIG. 11B (PRIOR ART)

The shapes of the apertures of the shadow mask before being stretched onto the mask frame in the central portion 9A and the end portions 9B in the X-axis direction shown in FIG. 7 are shown in detail in FIGS. 9A and 9B, respectively. As shown in the drawings, in this embodiment, the apertures of the region 9A in the central portion and the region 9B in the both end portions in the X-axis direction are formed in the bobbin shape in which the width of the aperture (width of the aperture in the X-axis direction) is narrow in the middle portion in the Y-axis direction.

The specific sizes of the aperture are shown below.

FIG. 6 is an enlarged front view showing an intended arrangement state of rectangular-shaped apertures in a state in which the shadow mask is stretched. In FIG. 6, the width of the aperture in the X-axis direction is W=0.2 mm; the width of the aperture in the Y-axis direction is H=10.5 mm; the arrangement pitch of the apertures in the X-axis direction is Ph=0.8 mm; and the arrangement pitch of the apertures in the Y-axis direction is Pv=11 mm.

In the shadow mask before being stretched, when the minimum width of the aperture of the bobbin-shaped aperture in the X-axis direction is W0 both in FIGS. 9A and 9B, the correction rate C (%) of the aperture width in the X-axis direction is represented by the following equation:

$$C=(\mathbf{W0}-W)/W\times 100.$$

At this time, the correction rates C of the bobbin-shaped aperture shown in FIG. 9A (central portion 9A in FIG. 7) and the bobbin-shaped aperture shown in FIG. 9B (end portions 9B in FIG. 7) are −5% and −7%, respectively. The correction rates of the apertures positioned from the central portion 9A to the end portions 9B are varied gradually from −5% to −7%. The widths of the apertures in the end portions in the Y-axis direction are substantially constant (the width of the end portions 9B is narrower than that of the central portion 9B by 1%).

The shadow mask including the above-mentioned apertures was stretched with the application of tension shown in FIG. 8, thereby forming the mask structure 10 shown in FIG. 2. Consequently, it was confirmed that the apertures had uniform rectangular shapes as designed over the entire surface. Furthermore, when the cathode ray tube 1 shown in FIG. 1 incorporating this mask structure 10 was produced, color unevenness was hardly found over the entire screen.

The above-mentioned first and second embodiments are just examples for explaining the present invention and the examples of numerals are not necessarily limited to the above mentioned examples. According to the investigation by the present inventors, in the shadow mask to which tension having a distribution shown in FIGS. 4 and 8 are applied in the Y-axis direction, it is preferable that in the shadow mask before being stretched, the apertures are formed so that the width of the aperture in the middle portion in the Y-axis direction narrows gradually from the central portion towards the both end portions in the X-axis direction (that is, so that the above-mentioned correction rate C gradually is reduced from the central portion towards the both end portions in the X-axis direction). At this time, the widths of the apertures in the both end portions in the Y-axis direction are substantially constant in the X-axis direction. Therefore, as a specific embodiment, besides the above-mentioned embodiments 1 and 2, the apertures may be a formed in a barrel shape both in the central portion and the end portions in the X-axis direction and the maximum aperture width thereof may be decreased from the central portion to the end portions in the X-axis direction. The embodiment may be selected dependent on the size of each part of the shadow mask, the magnitude and the distribution of tension to be applied, and the like.

Furthermore, as shown in FIGS. 3 and 7, by producing the bobbin-shaped shadow mask in which the middle portion in the direction in which tension is to be applied is narrowed, the distribution of tension becomes similar to FIGS. 4 and 8, in the direction perpendicular to the direction in which tension is to be applied, tension is maximum in the central portion and gradually reduced as it approaches to the end portions.

In the above-mentioned example, the case where tension is applied in the direction of the shorter side of the shadow mask is explained. However, the present invention can be applied to the case where tension is applied in the direction of the longer side of the shadow mask. In this case, the shape of the apertures may be varied gradually as mentioned above between the central portion and both end portions in the direction of the shorter side. In this case, needless to say, the direction of the shorter side is the direction of a scanning line and the direction of the longer side is the direction of the longitudinal axis of the aperture.

The invention may be embodied in other forms without departing from the spirit or essential characteristics thereof. The embodiments disclosed in this application are to be considered in all respects as illustrative and not limitative, the scope of the invention is indicated by the appended claims rather than by the foregoing description, and all changes which come within the meaning and range of equivalency of the claims are intended to be embraced therein.

What is claimed is:

1. A cathode ray tube comprising a pair of supports disposed in parallel facing each other, and a shadow mask acting as a color selection electrode including a large number of apertures, the shadow mask being stretched and held by the supports in a state in which tension is applied to the shadow mask by the supports, wherein:

in the shadow mask before being stretched onto the supports, the shapes of the aperture are varied so that the width of the aperture in the middle portion in the direction in which tension is to be applied gradually narrows from a central portion towards both end portions in the direction parallel to the longitudinal direction of the support.

2. The cathode ray tube according to claim 1, wherein in the shadow mask before being stretched onto the supports, the width of the shadow mask in the direction parallel to the longitudinal direction of the support is wide in the both end portions and narrow in the middle portion in the direction in which tension is to be applied.

3. The cathode ray tube according to claim 1, wherein tension applied to the shadow mask in the central portion is larger than tension applied to the shadow mask in the both end portions in the direction parallel to the longitudinal direction of the support.

4. The cathode ray tube according to claim 1, wherein in the shadow mask before being stretched onto the supports, the apertures formed in the central portion in the direction parallel to the longitudinal direction of the support have a barrel shape having a large width in the middle portion in the direction in which tension is to be applied, and the apertures formed in the both end portions in the direction parallel to the longitudinal direction of the support have a bobbin shape having a narrow width in the middle portion in the direction in which tension is to be applied.

* * * * *